US008794338B2

(12) United States Patent
Greci et al.

(10) Patent No.: US 8,794,338 B2
(45) **Date of Patent: *Aug. 5, 2014**

(54) ROTATING AND TRANSLATING SHUNT TUBE ASSEMBLY

(71) Applicant: Halliburton Energy Services, Inc., Houston, TX (US)

(72) Inventors: Stephen Michael Greci, McKinney, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/019,083

(22) Filed: Sep. 5, 2013

(65) Prior Publication Data

US 2014/0000913 A1 Jan. 2, 2014

Related U.S. Application Data

(63) Continuation of application No. 13/408,856, filed on Feb. 29, 2012.

(51) Int. Cl.
*E21B 19/16* (2006.01)

(52) U.S. Cl.
USPC ..... 166/380; 166/51; 166/236

(58) Field of Classification Search
USPC ..... 166/278, 51, 236, 227, 378, 380; 285/41, 123.15
See application file for complete search history.

(56) References Cited

U.S. PATENT DOCUMENTS

| | | | | |
|---|---|---|---|---|
| 5,341,880 | A * | 8/1994 | Thorstensen et al. | 166/278 |
| 5,390,966 | A * | 2/1995 | Cox et al. | 285/124.2 |
| 5,868,200 | A * | 2/1999 | Bryant et al. | 166/51 |
| 6,409,219 | B1 * | 6/2002 | Broome et al. | 285/3 |
| 6,516,881 | B2 * | 2/2003 | Hailey, Jr. | 166/278 |
| 6,698,518 | B2 | 3/2004 | Royer et al. | |
| 7,784,532 | B2 * | 8/2010 | Sevre et al. | 166/51 |
| 7,866,708 | B2 * | 1/2011 | Johnson et al. | 285/123.15 |
| 2004/0074641 | A1 | 4/2004 | Hejl et al. | |
| 2005/0284643 | A1 | 12/2005 | Setterberg | |
| 2009/0159270 | A1 | 6/2009 | Setterberg, Jr. et al. | |

(Continued)

FOREIGN PATENT DOCUMENTS

WO 2013130269 A1 9/2013

OTHER PUBLICATIONS

Foreign Communication from a Related Counterpart Application, International Search Report and Written Opinion dated Jun. 2, 2013, International Application No. PCT/US13/26005 filed on Feb. 14, 2013.

(Continued)

*Primary Examiner* — Nicole Coy

(57) ABSTRACT

A tubular assembly comprises a wellbore tubular, at least one shunt tube, and a coupling assembly configured to rotatably couple the at least one shunt tube to the wellbore tubular. A method of coupling the tubular assemblies comprises coupling a first wellbore tubular to a second wellbore tubular, wherein a first shunt tube is coupled to the first wellbore tubular, rotating a second shunt tube about the second wellbore tubular that is coupled to the first wellbore tubular until the second shunt tube is substantially aligned with the first shunt tube, and coupling the first shunt tube to the second shunt tube.

20 Claims, 14 Drawing Sheets

(56) References Cited

U.S. PATENT DOCUMENTS

| | | | | |
|---|---|---|---|---|
| 2010/0155064 | A1 | 6/2010 | Nutley et al. | |
| 2010/0236775 | A1 * | 9/2010 | Sevre et al. | 166/188 |
| 2013/0220635 | A1 | 8/2013 | Greci et al. | |

OTHER PUBLICATIONS

FAIPP Pre-Communication dated Oct. 31, 2013, filed on Feb. 29, 2012, U.S. Appl. No. 13/408,856.

FAIPP Office Action dated Jan. 9, 2014, filed on Feb. 29, 2012, U.S. Appl. No. 13/408,856.

Final Office Action dated Apr. 25, 2014, filed Feb. 29, 2012, U.S. Appl. No. 13/408,856.

Notice of Allowance dated May 30, 2014, filed Feb. 29, 2012, U.S. Appl. No. 13/408,856.

* cited by examiner

ROTATING AND TRANSLATING SHUNT TUBE ASSEMBLY

CROSS-REFERENCE TO RELATED APPLICATIONS

This application is a continuation of and claims priority under 35 U.S.C. §120 to U.S. patent application Ser. No. 13/408,856, filed on Feb. 29, 2012, entitled "Rotating and Translating Shunt Tube Assembly", by Stephen Michael Greci, et al., which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine sand that can erode production components in the flow path. In some completions, the wellbore is uncased, and an open face is established across the oil or gas bearing zone. Such open bore hole (uncased) arrangements are typically utilized, for example, in water wells, test wells, and horizontal well completions.

When formation sand is expected to be encountered, one or more sand screens can be installed in the flow path between the production tubing and the perforated casing (cased) and/or the open well bore face (uncased). A packer is customarily set above the sand screen to seal off the annulus in the zone where production fluids flow into the production tubing. The annulus around the screen can then be packed with a relatively coarse sand (or gravel) which acts as a filter to reduce the amount of fine formation sand reaching the screen. The packing sand is pumped down the work string in a slurry of water and/or gel and fills the annulus between the sand screen and the well casing. In well installations in which the screen is suspended in an uncased open bore, the sand or gravel pack may serve to support the surrounding unconsolidated formation.

During the sand packing process, annular sand "bridges" can form around the sand screen that may prevent the complete circumscribing of the screen structure with packing sand in the completed well. This incomplete screen structure coverage by the packing sand may leave an axial portion of the sand screen exposed to the fine formation sand, thereby undesirably lowering the overall filtering efficiency of the sand screen structure.

One conventional approach to overcoming this packing sand bridging problem has been to provide each generally tubular filter section with a series of shunt tubes that longitudinally extend through the filter section, with opposite ends of each shunt tube projecting outwardly beyond the active filter portion of the filter section. In the assembled sand screen structure, the shunt tube series are axially joined to one another to form a shunt path extending along the entire length of the sand screen structure. The shunt path operates to permit the inflowing packing sand/gel slurry to bypass any sand bridges that may be formed and permit the slurry to enter the screen/casing annulus beneath a sand bridge, thereby forming the desired sand pack beneath it.

SUMMARY

In an embodiment, a tubular assembly comprises a wellbore tubular, at least one shunt tube, and a coupling assembly configured to rotatably couple at least one shunt tube to the wellbore tubular.

In an embodiment, a method comprises coupling a first wellbore tubular to a second wellbore tubular, wherein a first shunt tube is coupled to the first wellbore tubular, rotating a second shunt tube about the second wellbore tubular that is coupled to the first wellbore tubular until the second shunt tube is substantially aligned with the first shunt tube, and coupling the first shunt tube to the second shunt tube.

In an embodiment, a method comprises coupling a shunt tube to a coupling assembly, and rotatably coupling the coupling assembly to a wellbore tubular.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
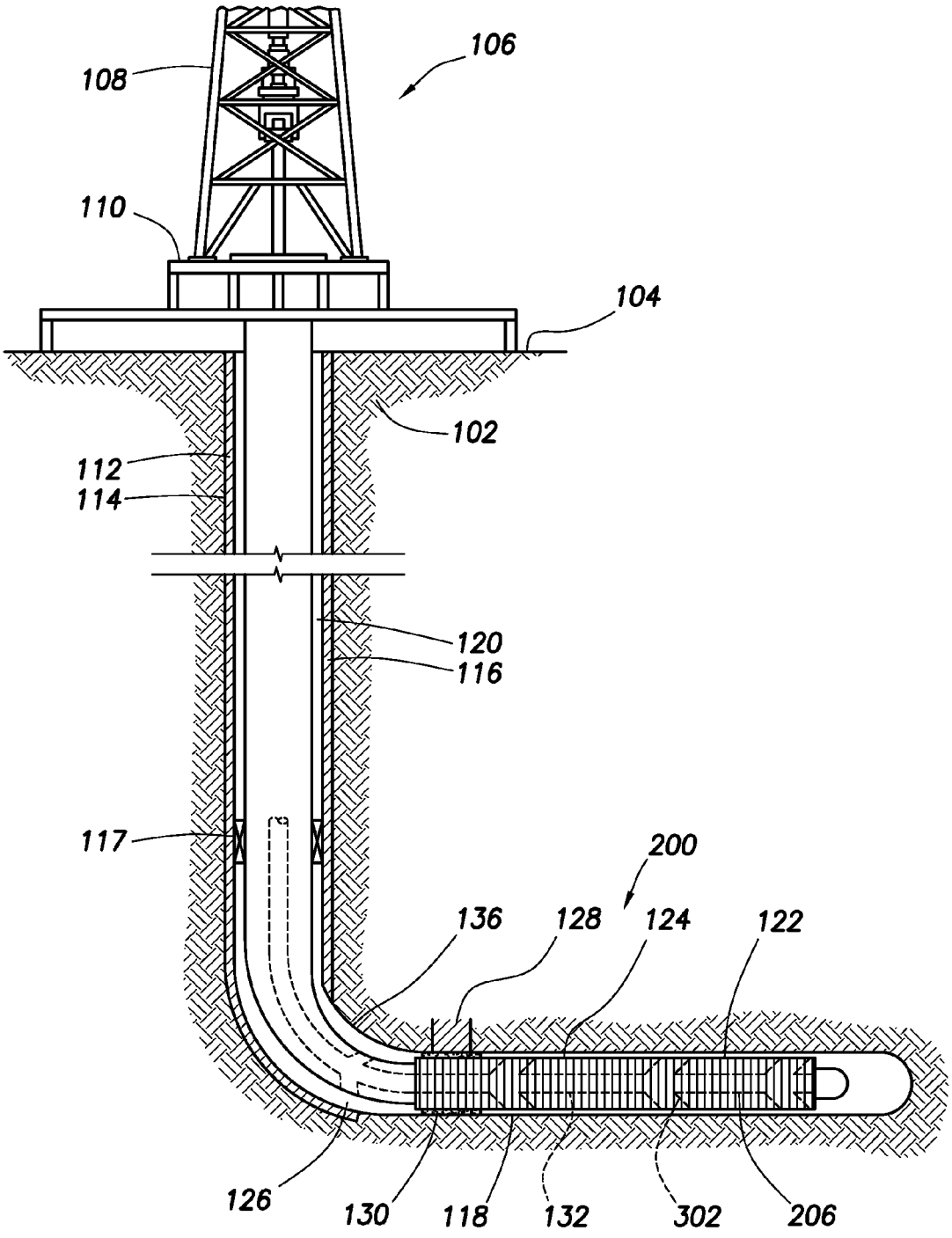
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal" or "longitudinally" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

The use of shunt tubes with threaded joints of wellbore tubulars that are interconnected often makes it difficult to align each adjacent pair of shunt tubes that must be interconnected to maintain axial continuity in the overall shunt tube flow path. In addition, jumper tubes must be used to couple the facing ends of each adjacent pair of shunt tubes to interconnect and provide fluid communication through the interiors of the shunt tubes in series. These problems tend to make the assembly of the overall sand screen structure relatively difficult and time consuming.

In order to solve these problems, the shunt tube assembly disclosed herein provides a mechanism to allow the shunt tubes and associated equipment (e.g., shroud, connection mechanism, etc.) to be rotatably coupled to the wellbore tubular. The shunt tube assembly may then be rotated into alignment with the previously prepared screen assembly to radially align the adjacent shunt tubes. The shunt tube assembly may then be fixed to the wellbore tubular to maintain the alignment between adjacent shunt tubes. The ends of the shunt tubes may then be coupled using jumper tubes.

Alternatively, the shunt tube assembly disclosed herein may provide a mechanism to both allow the shunt tubes and associated equipment to rotatably couple to the wellbore tubular and slidingly engage the wellbore tubular to allow for a limited longitudinal translation over at least a portion of the wellbore tubular. The configuration may allow the entire shunt tube assembly to be rotated into alignment with the previously prepared screen assembly and then longitudinally translated until the ends of the adjacent shunt tubes engage, thereby providing a continuous flow path through the shunt tubes, and potentially eliminating jumper tubes.

Referring to FIG. 1, an example of a wellbore operating environment in which a well screen assembly may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells. The wellbore may also be used for purposes other than hydrocarbon production such as geothermal recovery and the like.

A wellbore tubular 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string comprising a well screen assembly 122 comprising a shunt tube assembly disposed in the wellbore 114. It should be understood that the wellbore tubular 120 is equally applicable to any type of wellbore tubulars being inserted into a wellbore including as non-limiting examples drill pipe, casing, liners, jointed tubing, and/or coiled tubing. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in at least a portion of the wellbore 114.

In an embodiment, the wellbore tubular 120 may comprise a completion assembly string comprising one or more downhole tools (e.g., zonal isolation devices 117, screens assemblies 122, valves, etc.). The one or more downhole tools may take various forms. For example, a zonal isolation device 117 may be used to isolate the various zones within a wellbore 114 and may include, but is not limited to, a packer (e.g., production packer, gravel pack packer, frac-pac packer, etc.). While FIG. 1 illustrates a single screen assembly 122, the wellbore tubular 120 may comprise a plurality of screen assemblies 122. The zonal isolation devices 117 may be used between various ones of the screen assemblies 122, for example, to isolate different gravel pack zones or intervals along the wellbore 114 from each other.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

In use, the screen assembly 122 can be positioned in the wellbore 114 as part of the wellbore tubular string 120 adjacent a hydrocarbon bearing formation. An annulus 124 is formed between the screen assembly 122 and the wellbore 114. The gravel slurry 126 may travel through the annulus 124 between the well screen assembly 122 and the wellbore 114 wall as it is pumped down the wellbore around the screen assembly 122. Upon encountering a section of the subterranean formation 102 including an area of highly permeable material 128, the highly permeable area 128 can draw liquid from the slurry, thereby dehydrating the slurry. As the slurry dehydrates in the permeable area 128, the remaining solid particles form a sand bridge 130 and prevent further filling of the annulus 124 with gravel. One or more shunt tubes 132 may be used to create an alternative path for gravel around the sand bridge 130. The shunt tube 132 allows a slurry of sand to enter an apparatus and travel in the shunt tube 132 past the sand bridge 130 to reenter the annulus 124 downstream. The shunt tube 132 may be placed on the outside of the wellbore tubular 120 or run along the interior thereof.

The screen assembly 122 comprises one or more interconnected joints of threaded wellbore tubulars having shunt tube assemblies disposed about each joint of the wellbore tubulars. Adjacent sections must be substantially radially aligned to allow the ends of adjacent shunt tubes on adjacent sections to be coupled with jumper tubes or directly engaged. The present disclosure teaches the use of a rotating shunt tube assembly disposed about the wellbore tubular and coupled thereto by a coupling assembly to allow the shunt tube assembly to be rotated into alignment with the shunt tubes on an adjacent section and then fixed in position, thereby allowing for a faster and more efficient make up without the need for specialized timed threads on the wellbore tubular. While a number of rotating coupling assemblies can be used with the shunt tube assemblies disclosed herein, it will be appreciated that the coupling assembly is configured to provide for the rotation of the shunt tubes about the wellbore tubular. In an embodiment, the rotatable shunt tube assembly comprising the coupling assembly can then be configured to be retained in position using a suitable retaining mechanism, thereby providing for a substantially fixed engagement with the wellbore tubular once the shunt tubes have been substantially aligned with the shunt tubes on an adjacent joint of wellbore tubular.

Figure 2:
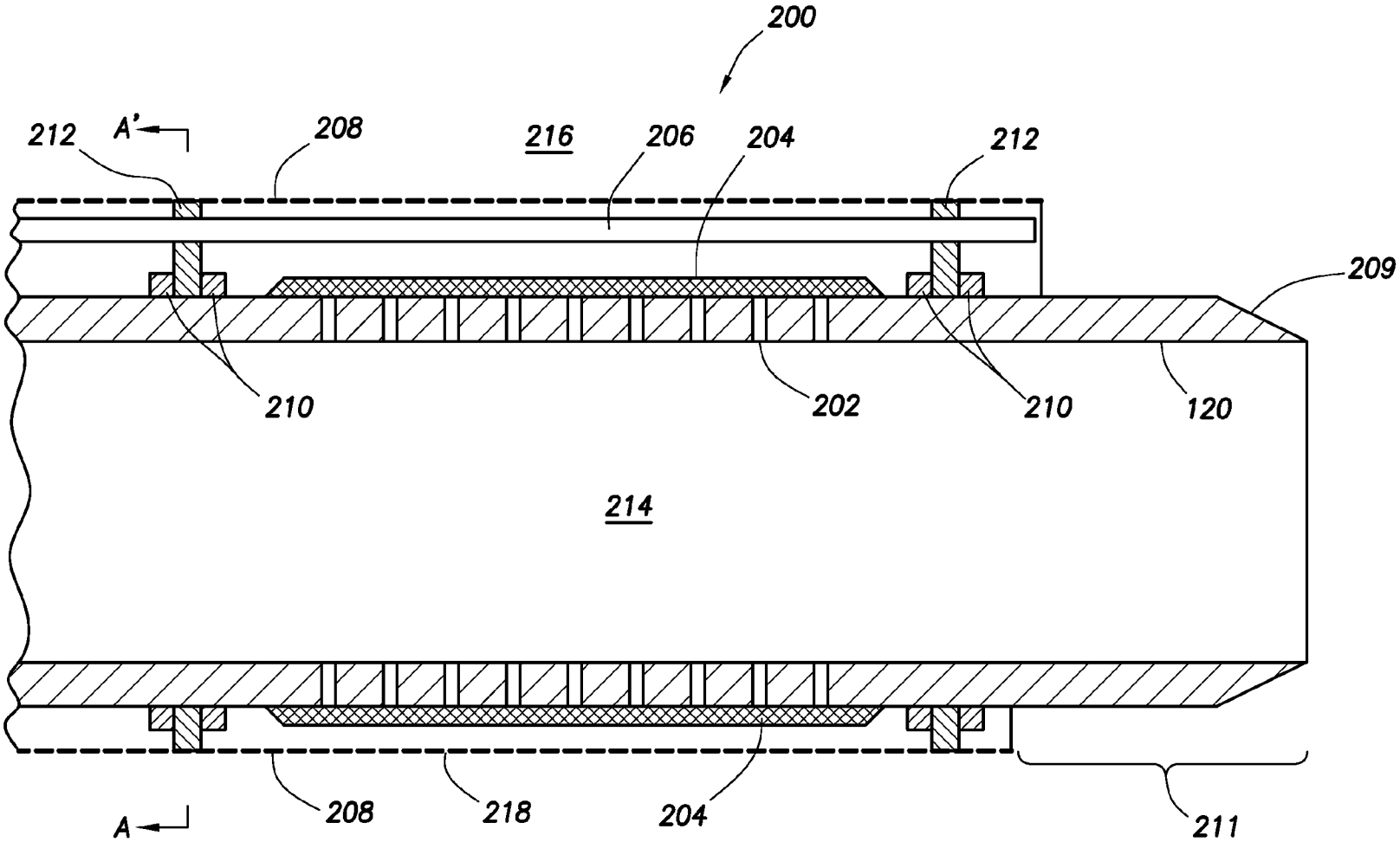
FIG. 2 is a cross-sectional view of an embodiment of a shunt tube assembly.

A cross-sectional view of an embodiment of an individual joint of threaded wellbore tubular comprising a shunt tube assembly 200 disposed thereabout is shown in FIG. 2. The wellbore tubular 120 generally comprises a series of perforations 202 disposed therethrough. A filter media 204 is disposed about the wellbore tubular 120 and the series of perforations 202 to screen the incoming fluids from the formation. The shunt tube assembly 200 comprises a coupling assembly and one or more shunt tubes 206 disposed along and generally parallel to the wellbore tubular 120. An outer body member 208 may be disposed about the wellbore tubular 120, one or more shunt tubes 206, and filter media 204. In an embodiment, the coupling assembly comprises one or more shunt rings 212 and optionally one or more stop rings 210 configured to retain one or more corresponding shunt rings 212 in position on the wellbore tubular 120. While generally discussed in terms of the one or more shunt rings 212 and the one or more stop rings 210, the coupling assembly may comprise various other configurations as described in more detail herein. The shunt rings 212 may be configured to retain the shunt tubes 206 and/or outer body member 208 about the wellbore tubular 120 while being free to rotate radially within the stop rings 210. The shunt rings 212 may also be configured to be fixed relative to the wellbore tubular 120 when the shunt tubes 206 are radially positioned in a desired alignment.

The wellbore tubular 120 comprises the series of perforations 202 through the wall thereof. The wellbore tubular 120 may comprise any of those types of wellbore tubular described above with respect to FIG. 1. While the wellbore tubular 120 is illustrated as being perforated in FIG. 2, the wellbore tubular 120 may be slotted and/or include perforations of any shape so long as the perforations permit fluid communication of production fluid between an interior throughbore 214 and an exterior 216 of the shunt tube assembly 200.

The wellbore tubular 120 may generally comprise a pin end 209 and a box end to allow the wellbore tubular 120 to be coupled to other wellbore tubulars having corresponding connections. As can be seen in FIG. 2, the wellbore tubular 120 may have a section 211 that extends beyond the shunt tube assembly 200. The exposed portion 211 of the wellbore tubular 120 may be used during the coupling process to allow one or more tools to engage the exposed portion 211 and thread the joint to an adjacent joint of wellbore tubular. In an embodiment, the exposed portion may be about 1 to 5 feet, or alternatively about 2 feet, though any distance suitable for allowing the wellbore tubular 120 to be coupled to an adjacent joint of wellbore tubular may be used.

The filter media 204 may be disposed about the wellbore tubular 120 and can serve to limit and/or prevent the entry of sand, formation fines, and/or other particular matter into the wellbore tubular 120. In an embodiment, the filter media 204 is of the type known as "wire-wrapped," since it is made up of a wire closely wrapped helically about a wellbore tubular 120, with a spacing between the wire wraps being chosen to allow fluid flow through the filter media 204 while keeping particulates that are greater than a selected size from passing between the wire wraps. While a particular type of filter media 204 is used in describing the present invention, it should be understood that the generic term "filter media" as used herein is intended to include and cover all types of similar structures which are commonly used in gravel pack well completions which permit the flow of fluids through the filter or screen while limiting and/or blocking the flow of particulates (e.g. other commercially-available screens, slotted or perforated liners or pipes; sintered-metal screens; sintered-sized, mesh screens; screened pipes; prepacked screens and/or liners; or combinations thereof).

Figure 3:
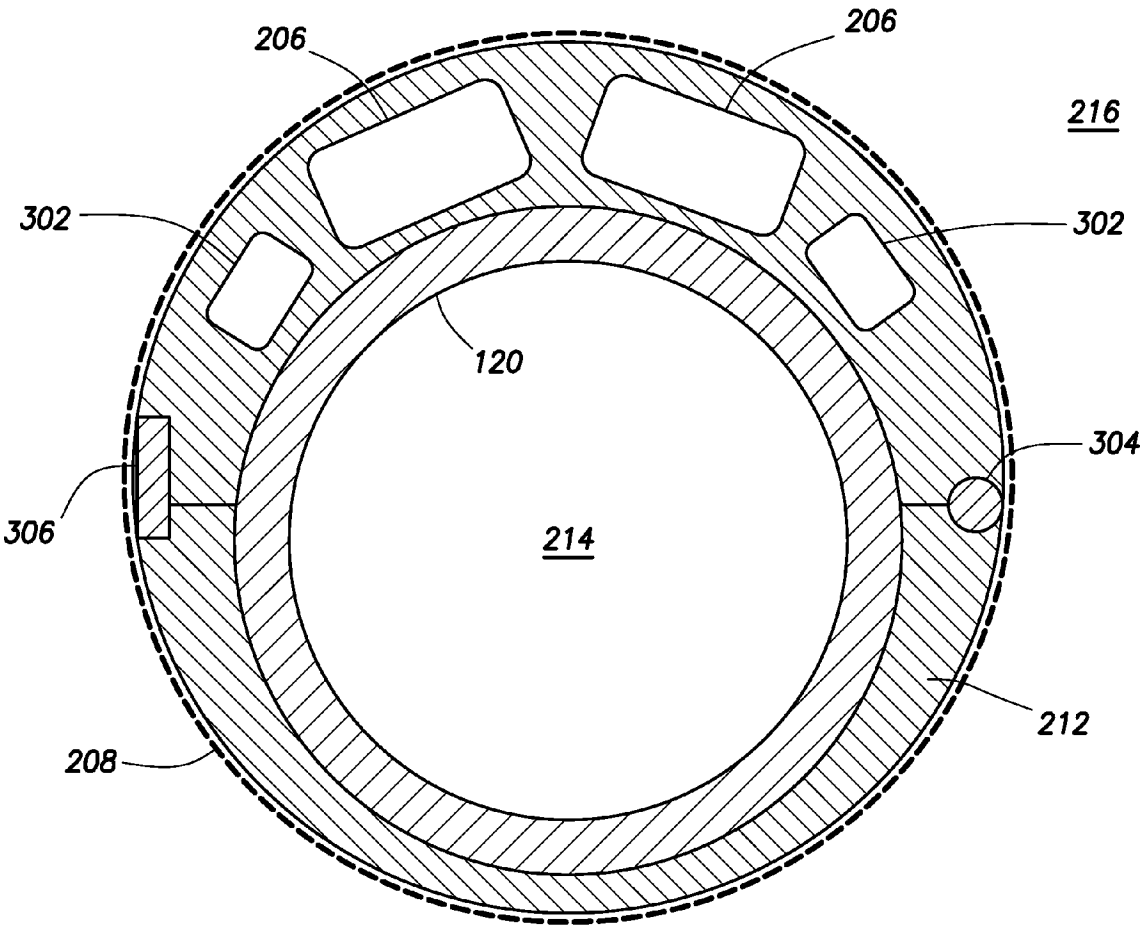
FIG. 3 is a cross-sectional view of an embodiment of a shunt tube assembly along line A-A' of FIG. 2.

The one or more shunt tubes 206 generally comprise tubular members disposed outside of and generally parallel to the wellbore tubular 120, though other positions and alignment may be possible. While described as tubular members, the one or more shunt tubes 206 may have shapes other than cylindrical and may generally be rectangular or trapezoidal in cross-section. The shunt rings 212 may retain the shunt tubes 206 in position relative to the wellbore tubular 120. The one or more shunt tubes 206 may be eccentrically aligned with respect to the wellbore tubular 120 as best seen in FIG. 3. In this embodiment, two shunt tubes 206 are arranged to one side of the wellbore tubular 120 within the outer body member 208. While illustrated in FIGS. 2 and 3 as having an eccentric alignment, other alignments of the one or more shunt tubes about the wellbore tubular 120 also may be possible.

Various configurations for providing fluid communication between the interior of the one or more shunt tubes 206 and the exterior 216 of the outer body member 208 are possible. In an embodiment, the one or more shunt tubes 206 may comprise a series of perforations aligned with one or more perforations in the outer body member 208. Upon the formation of a sand bridge, a back pressure generated by the blockage may cause the slurry carrying the sand to be diverted through the one or more shunt tubes 206 until bypassing the sand bridge. The slurry may then pass out of the one or more shunt tubes 206 through the perforations in both the shunt tubes 206 and outer body member 208 and into the annular space about the outer body member 208 to form a gravel pack.

In an embodiment, one or more packing tubes 302 may be disposed in fluid communication with the one or more shunt tubes 206. As illustrated in FIGS. 1 and 3, the packing tubes 302 may generally comprise tubular members disposed outside of and generally parallel to the wellbore tubular 120. The one or more shunt tubes 206 may be disposed generally parallel to the one or more shunt tubes 206 and may be retained in position relative to the wellbore tubular 120 by the shunt rings 212. The packing tubes 302 may be coupled to the one or more shunt tubes 206 at various points along their length at one end and comprise a series of perforations providing fluid communication within and/or through the outer body member 208 at a second end. As shown schematically in FIG. 1, the packing tubes 302 may form a branched structure along the length of a screen assembly 122 with the one or more shunt tubes 206 forming the trunk line and the one or more packing tubes 302 forming the branch lines.

In use, the branched configuration of the shunt tubes 206 and packing tubes 302 may provide the fluid pathway for a slurry to be diverted around a sand bridge. Upon the formation of a sand bridge, a back pressure generated by the blockage may cause the slurry carrying the sand to be diverted through the one or more shunt tubes 206 until bypassing the sand bridge. The slurry may then pass out of the one or more shunt tubes 206 into the one or more packing tubes 302. While flowing through the one or more packing tubes 302, the slurry may pass through the perforations in both the packing tubes 302 and outer body member 208 and into the annular space about the outer body member 208 to form a gravel pack.

To protect the shunt tubes 206, packing tubes 302, and/or filter media 204 from damage during installation of the screen assembly comprising the shunt tube assembly 200 within the wellbore, the outer body member 208 may be positioned about a portion of the shunt tube assembly 200. The outer body member 208 comprises a generally cylindrical member formed from a suitable material (e.g. steel) that can be secured at one or more points to the shunt rings 212, which, in turn, are secured to wellbore tubular 120 as described in more detail below. The outer body member 208 may have a plurality of openings 218 (only one of which is numbered in FIG. 2) through the wall thereof to provide an exit for fluid (e.g., gravel slurry) to pass out of the outer body member 208 as it flows out of one or more openings in the shunt tubes 206 and/or packing tubes 302, and/or an entrance for fluids into the outer body member 208 and through the permeable section of the filter media 204 during production. By positioning the outer body member 208 over the shunt tube assembly 200, the shunt tubes 206, packing tubes 302, and/or filter media 204 can be protected from any accidental impacts during the assembly and installation of the screen assembly in the wellbore that might otherwise severely damage or destroy one or more components of the screen assembly or the shunt tube assembly 200.

As illustrated in FIGS. 2 and 3, the shunt tubes 206, packing tubes 302, outer body member 208, and/or in some embodiments, the filter media 204, can be retained in position relative to the wellbore tubular 120 using the coupling assembly, which in an embodiment comprises the shunt rings 212 and the stop rings 210. While a variety of configurations of the coupling assembly can be used, it will be appreciated that the coupling assembly is configured to allow the shunt tubes 206 and any packing tubes 302 to be radially rotated about the longitudinal axis of the wellbore tubular 120. The radial rotation may allow the shunt tubes 206 and any packing tubes 302 to be aligned with the corresponding shunt tubes, and optionally any packing tubes, on an adjacent joint of wellbore tubular.

The one or more stop rings 210 may be configured to retain one or more corresponding shunt rings 212 in position. The stop rings 210 may comprise an annular ring of suitable high strength material (e.g., steel) suitably coupled to the outer surface of the wellbore tubular 120. In an embodiment, the stop rings 210 may be welded, brazed, built up, and/or integrally formed with the wellbore tubular 120. In an embodiment, the stop rings 210 may be coupled to the wellbore tubular 120 using one or more attachment means such as a set screw, band, latch, etc. As used herein, the term "screw" and/or "set screw" refers to any of a variety of attachment mechanisms such as screws, bolts, and the like. The stop rings generally comprise a shape and height extending outward from the surface of the wellbore tubular 120 sufficient to retain a shunt ring 212 in a longitudinal position relative to the wellbore tubular 120.

The shunt rings 212 generally comprise removable rings and/or clamps configured to engage the wellbore tubular 120 and/or the stop rings 210. FIG. 3 illustrates a cross-sectional view along line A-A' of FIG. 2 that shows the cross section of a shunt ring 212. In the embodiment shown in FIG. 3, the shunt ring extends around the wellbore tubular 120. A plurality of through passages are provided in the shunt ring 212 to allow the one or more shunt tubes 206 and the one or more packing tubes 302 to pass through a portion of the shunt ring 212. The shunt ring 212 may also be configured to engage and retain the outer body member 208 in position about the wellbore tubular 120.

In an embodiment, the shunt ring 212 can comprise a hinged clamp to allow the shunt ring 212 to be opened, disposed about the wellbore tubular 120, and then closed to engage the wellbore tubular 120 and/or the stop ring 210. As illustrated in FIG. 3, the shunt ring 212 may comprise a hinge 304 and a latch mechanism 306. The latch mechanism 306 may allow the shunt ring 212 to be opened, and subsequently re-engaged to retain the shunt ring 212 about the wellbore tubular 120. The latch mechanism 306 may comprise any type of latch known in the art suitable for retaining the shunt ring 212 in an engaged position. In the engaged position, the shunt ring 212 may be configured to be rotatable in a radial direction with respect to the wellbore tubular 120 and any stop rings 210. This configuration may allow the shunt ring 212 and the components retained by the shunt ring 212 to be radially rotated about the longitudinal axis of the wellbore tubular 120. The latch mechanism 306 may comprise a secondary coupling assembly to allow for a compressional force to be applied by the shunt ring 212 to the wellbore tubular and/or a separate locking mechanism may be used to provide a fixed engagement between the shunt ring 212 and the wellbore tubular 120 and/or the stop rings 210, as described in more detail below.

Figure 4A:
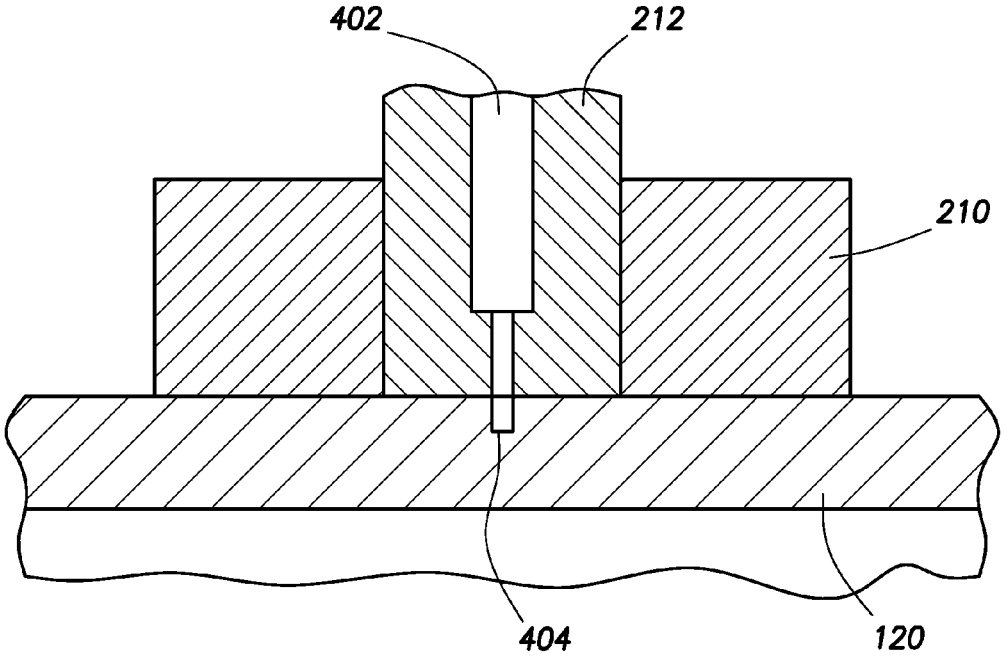
FIGS. 4A-4D are partial cross-sectional views of embodiments of shunt ring assemblies.

A variety of configurations of the coupling assembly, which may comprise the shunt ring 212 and/or the stop ring 210 are shown in FIGS. 4A through 4D, each of which represents a close-up cross-sectional view along the same alignment as illustrated in FIG. 2. As shown in FIG. 4A, the coupling assembly comprises the shunt ring 212 disposed between two stop rings 210 when the shunt ring 212 is disposed about the wellbore tubular 120. In this configuration, the shunt ring 212 may directly engage the wellbore tubular 120 while being free to radially rotate about the longitudinal axis of the wellbore tubular 120 between the stop rings 210. A channel 402 may be disposed in the shunt ring 212 and configured to receive a set screw. An optional recess 404 may be disposed in the wellbore tubular 120 in radial alignment with the channel 402 for receiving a set screw or other retaining device positioned within the channel 402. In an embodiment, a plurality of channels 402 and optional recesses 404 may be disposed about the circumference of the shunt ring 212 and wellbore tubular 120, respectively, to allow for a plurality of set screws to be used to retain the shunt ring 212 in a rotational position with respect to the wellbore tubular 120. In this embodiment, the shunt ring 212 may be engaged with the wellbore tubular 120 between the stop rings 210. The shunt ring 212 and the associated components of the shunt tube assembly 200 may then be rotated into a desired alignment. One or more set screws can then be engaged with the channels 402 and optional recesses 404 to retain the shunt ring 212 in position.

Figure 4B:
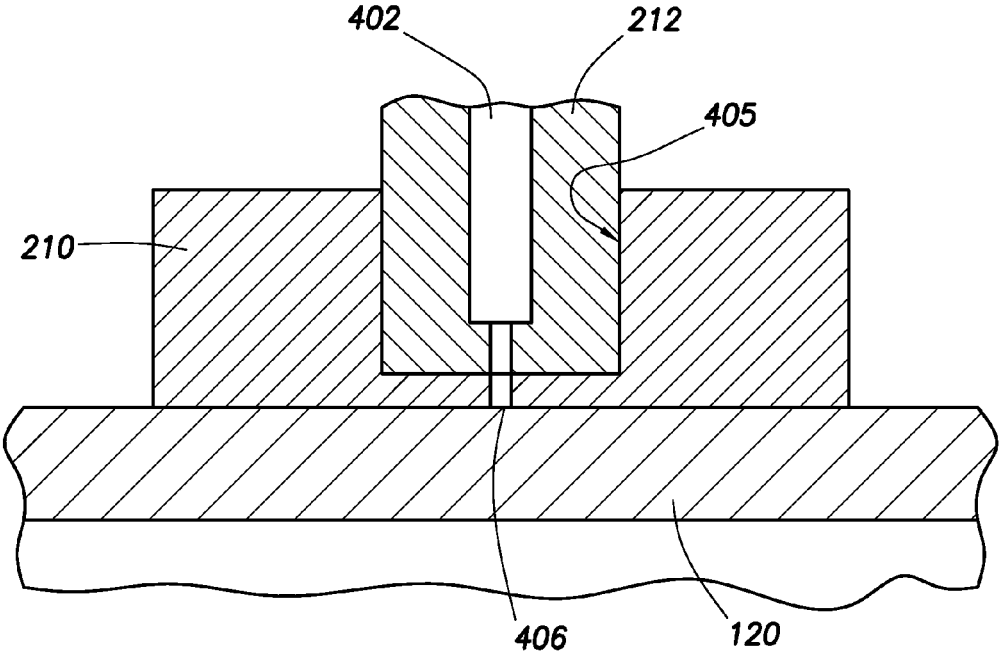

As shown in FIG. 4B, a stop ring 210 comprises a channel 405 for receiving the shunt ring 212. In this configuration, the shunt ring 212 engages the stop ring 210 rather than the wellbore tubular 120 and is free to radially rotate about the longitudinal axis of the wellbore tubular 120 within the channel 405. A channel 402 may be disposed in the shunt ring 212 and configured to receive a set screw. An optional recess 406 may be disposed in the stop ring 210 in radial alignment with the channel 402 for receiving a set screw or other retaining device positioned within the channel 402. In an embodiment, a plurality of channels 402 and optional recesses 406 may be disposed about the circumference of the shunt ring 212 and the stop ring 210, respectively, to allow for a plurality of set screws to be used to retain the shunt ring 212 in a rotational position with respect to the wellbore tubular 120. In this embodiment, the shunt ring 212 may first be engaged within the channel 405. The shunt ring 212 and the associated components of the shunt tube assembly may then be rotated into a desired alignment. One or more set screws can then be engaged with the channels 402 and optional recesses 406 to retain the shunt ring 212 in position.

Figure 4C:
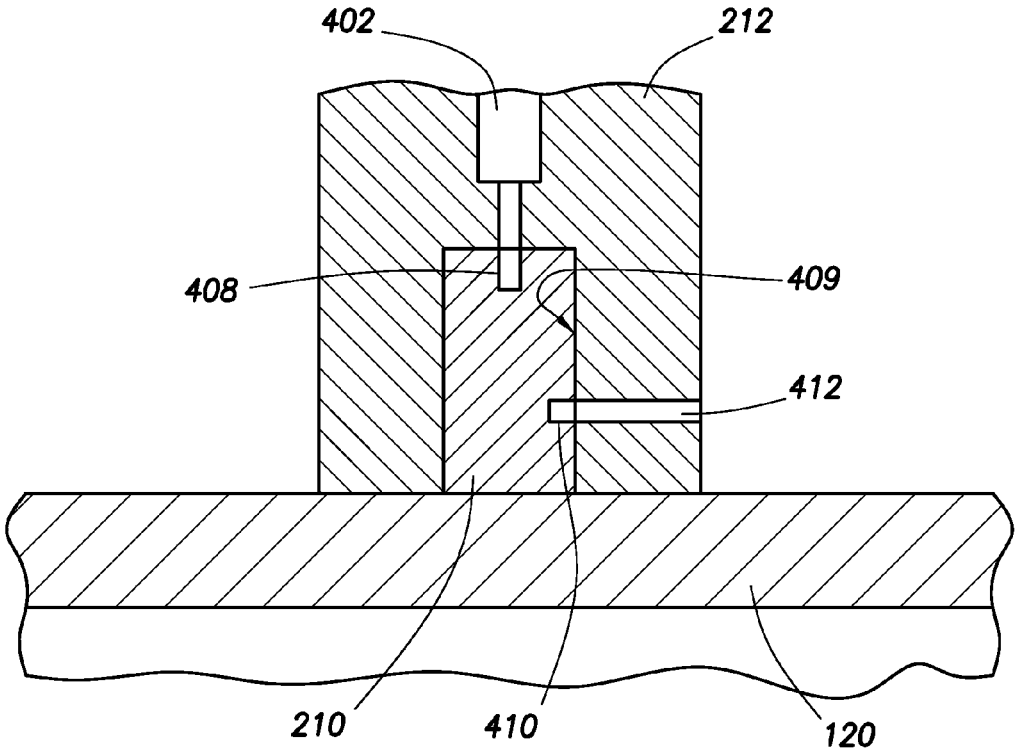

As shown in FIG. 4C, a stop ring 210 comprises a single protrusion that is engaged with the wellbore tubular 120. In this configuration, the shunt ring 212 comprises a channel 409 having a corresponding shape to engage the stop ring 210. The shunt ring 212 may engage the stop ring 210 and/or the wellbore tubular 120, and is free to radially rotate about the longitudinal axis of the wellbore tubular 120 while being restrained from longitudinally translating along the wellbore tubular due to the interaction with the stop ring 210 in the channel 409. A channel 402 may be disposed in the shunt ring 212 and configured to receive a set screw. An optional recess 408 may be disposed in the stop ring 210 in radial alignment with the channel 402 for receiving a set screw or other retaining device positioned within the channel 402. As shown in FIG. 4C, a channel 412 for receiving a set screw may also be disposed in a side wall of the shunt ring 212 and may be aligned with an optional recess 410 in the stop ring 210. In an embodiment, a plurality of channels 402, 412 and optional recesses 408, 410 may be disposed about the shunt ring 212 and the stop ring 210, respectively, to allow for a plurality of set screws to be used to retain the shunt ring 212 in a rotational position with respect to the wellbore tubular 120. In this embodiment, the shunt ring 212 may first be engaged about the stop ring 210. The shunt ring 212 and the associated components of the shunt tube assembly may then be rotated into a desired alignment. One or more set screws can then be engaged with the channels 402, 412 and optional recesses 408, 410 to retain the shunt ring 212 in position.

Figure 4D:
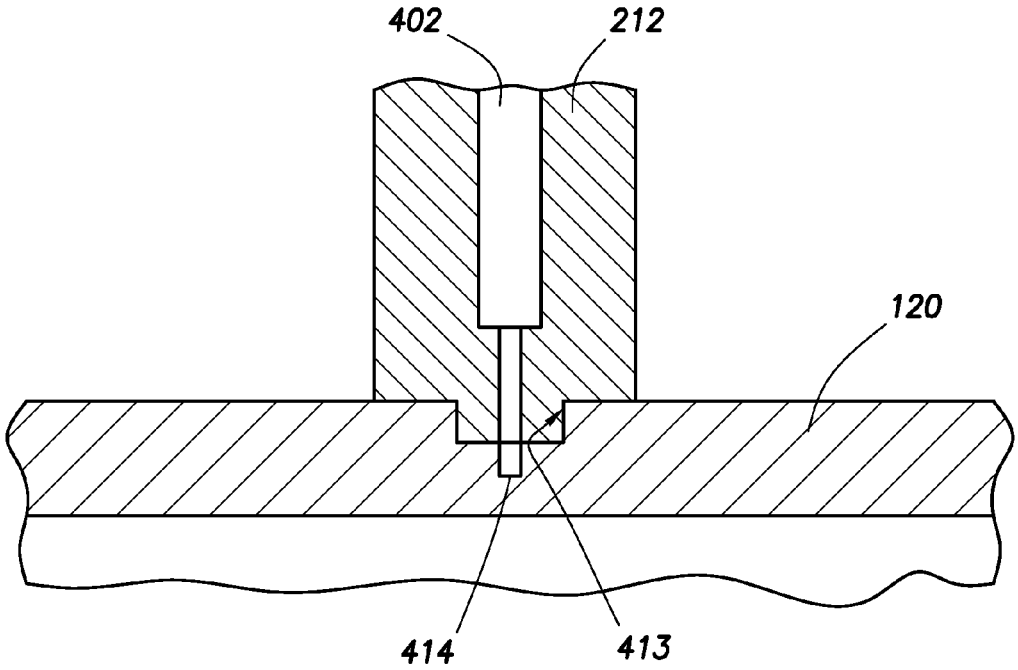

As shown in FIG. 4D, the shunt ring 212 may engage the wellbore tubular 120 without the use of a stop ring 210. In this embodiment, the wellbore tubular 120 may comprise a channel 413 for receiving the shunt ring 212 and/or a portion of the shunt ring 212 forming a protrusion. The shunt ring 212 may comprise a corresponding shape to engage the channel 413 in the wellbore tubular 120. Due to the interaction of the shunt ring 212 with the channel 413, the shunt ring 212 may be free to radially rotate about the longitudinal axis of the wellbore tubular 120 while being restrained from longitudinally translating along the wellbore tubular 120. A channel 402 may be disposed in the shunt ring 212 and configured to receive a set screw. An optional recess 414 may be disposed in the wellbore tubular 120 in radial alignment with the channel 402 for receiving a set screw or other retaining device positioned within the channel 402. In an embodiment, a plurality of channels 402 and optional recesses 414 may be disposed about the shunt ring 212 and the wellbore tubular 120, respectively, to allow for a plurality of set screws to be used to retain the shunt ring 212 in a rotational position with respect to the wellbore tubular 120. In this embodiment, the shunt ring 212 may first be engaged about the wellbore tubular 120 in engagement with the channel 413 in the wellbore tubular 120. The shunt ring 212 and the associated components of the shunt tube assembly may then be rotated into a desired alignment. One or more set screws can then be engaged with the channel 402 and optional recess 414 to retain the shunt ring 212 in position.

While illustrated as being fixed in position with one or more set screws, the shunt ring 212 may be retained in position using any of a variety of retaining mechanisms. Suitable retaining mechanisms may include, but are not limited to, corresponding surface features, adhesives, curable components, spot welds, any other suitable retaining mechanisms, and any combination thereof. For example, the inner surface of the shunt ring 212 may comprise corrugations, castellations, scallops, and/or other surface features, which in an embodiment, may be aligned generally parallel to the longitudinal axis of the wellbore tubular 120. The corresponding outer surface of the wellbore tubular 120 and/or stop ring 210 may comprise corresponding surface features. The shunt ring 212 may first be engaged with the wellbore tubular 120 and/or stop ring 210 as described above so that the shunt ring 212 is free to radially rotate about the longitudinal axis of the wellbore tubular 120. Upon being aligned, an additional closing force may be applied to the shunt ring 212 to cause the corresponding surface features on the inner surface of the shunt ring 212 to engage the surface features on the wellbore tubular 120 and/or stop ring 210, thereby preventing any further rotation of the shunt ring 212 about the wellbore tubular 120.

While the joints of wellbore tubular described herein are generally described as comprising a series of perforations 202 and filter media 204, one or more joints of wellbore tubular 120 may only have the shunt tube assemblies disposed thereabout. Such a configuration may be used between joints of wellbore tubular 120 comprising production sections to act as spacers or blank sections while still allowing for a continuous fluid path through the shunt tubes 206 along the length of the interval being completed.

In an embodiment, an assembled sand screen structure can be made up of several joints of the wellbore tubular comprising the shunt tube assemblies 200 described herein. During the formation of the assembled sand screen structure, the shunt tubes 206 on the respective joints are fluidly connected to each other as the joints are coupled together to provide a continuous flowpath for the gravel slurry along the entire length of assembled sand screen structure during gravel packing operations.

In previous sand screen structures, joints of wellbore tubulars comprising screens were connected by first threading together adjacent joints using timed threads to substantially align the shunt tubes on the adjacent joints. The end of each shunt tube on the adjacent joints was then individually connected using a connector such as a jumper tube. A typical jumper tube comprises of relatively short length of tubing which has a coupling assembly at each end for connecting the jumper tube to the shunt tubes. Typically, the jumper tube was assembled onto the aligned shunt tubes after the adjacent joints of wellbore tubular have been connected together. Thus, the previous screen assemblies required that the adjacent joints were substantially axially aligned before a connection between the shunt tubes could be made. This is sometime difficult to achieve and can require additional time to properly align the respective shunt tubes as the wellbore tubulars are threaded together. Due to the large number of connections which have to be made in a typical overall screen assembly, this can substantially increase the run-in time, and hence, the costs for screen.

Figure 5A:
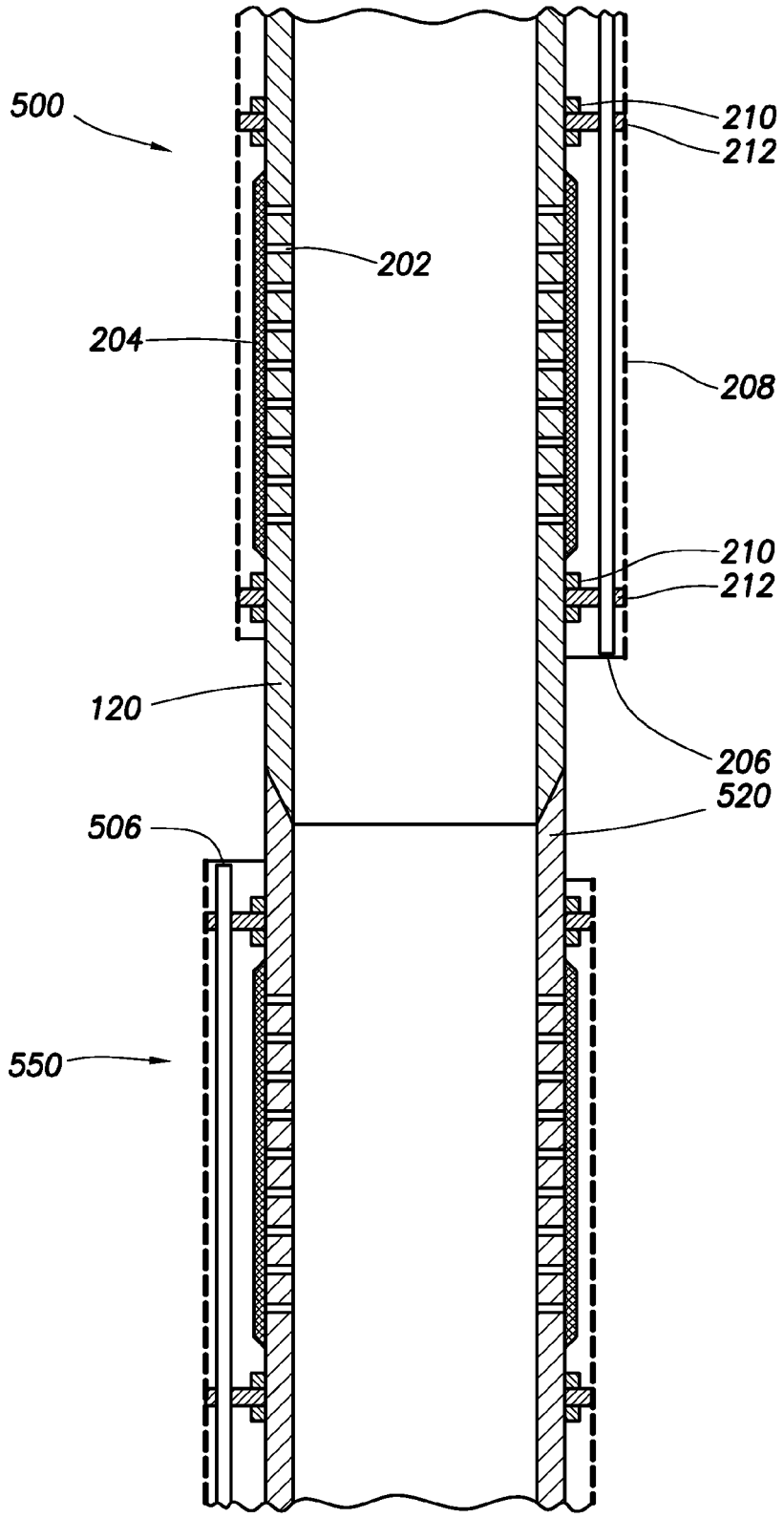
FIGS. 5A-5B are partial cross-sectional views of an embodiment of a shunt tube assembly during an embodiment of a coupling process.

Rather than requiring that the adjacent joints of the screen assemblies be substantially aligned during the coupling of the wellbore tubulars 120, the wellbore tubular joints 120 can first be coupled and the shunt tube assembly can be rotated to substantially align a shunt tube with a shunt tube on an adjacent wellbore tubular, thereby providing a faster and more efficient coupling process. In an embodiment as shown in FIG. 5A, the coupling process may begin by providing a wellbore tubular 120 having the series of perforations 202, the filter media 204, and the stop rings 210 coupled thereto. A shunt tube assembly 500 comprising the shunt rings 212 coupled to the shunt tubes 206, and optionally one or more packing tubes and/or the outer body member 208 may then be engaged with the wellbore tubular 120, with the shunt rings 212 being engaged with the stop rings 210 and/or the wellbore tubular 120 as described herein. In an embodiment, the shunt tubes 206 may be disposed within the openings in the shunt rings 212 and/or the shunt ring can be configured to open, receive the shunt tubes, and then close to retain the shunt tubes 206. The packing tubes may be similarly coupled to the shunt rings 212. The completed joint of the screen assembly may then be ready for coupling to an adjacent joint.

Figure 5B:
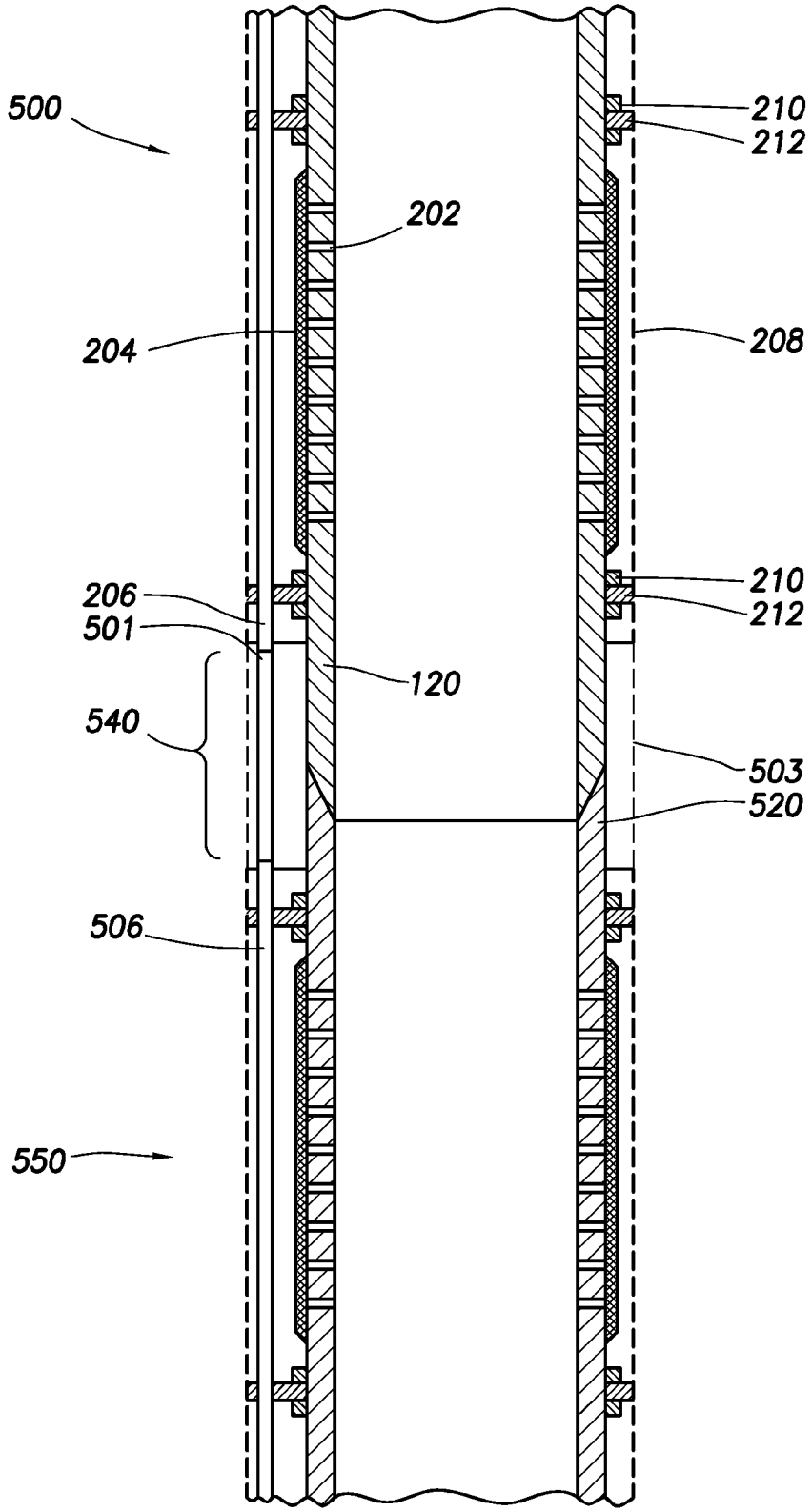

As shown in FIG. 5A, the coupling process may begin with the coupling a first joint of wellbore tubular 120 comprising a shunt tube assembly 500 to a second joint of wellbore tubular 520 comprising a shunt tube assembly 550. The wellbore tubular sections 120, 520 may generally comprise a pin and box type connection that can be threaded together and torqued according to standard connection techniques. Once coupled, the end of a first shunt tube 206 of the first shunt tube assembly 500 may be out of alignment with the adjacent end of a second shunt tube 506 of the second shunt tube assembly 550. As shown in FIG. 5B, the entire first shunt tube assembly 500 may be rotated about the longitudinal axis of the wellbore tubular 120 to substantially axially align the first shunt tube 206 with the adjacent end of a second shunt tube 506. Once the adjacent shunt tubes 206, 506 are substantially aligned, the shunt ring 212 may be restrained from further radial rotation about the longitudinal axis of the wellbore tubular 120 using any of the retaining mechanisms described above. It can be noted that the shunt tube assembly 500 is prevented from any substantial longitudinal movement based on the interaction of the shunt rings 212 with the stop rings 210 and/or the wellbore tubular 120.

Once the adjacent shunt tubes 206, 506 are substantially aligned, a jumper tube 501 may be used to provide a fluid coupling between the adjacent shunt tubes 206, 506. In an embodiment, the jumper tube 501 is coupled to the adjacent ends of the adjacent shunt tubes 206, 506 and a coupling assembly is used to securely engage the jumper tube 501 to the respective end of the shunt tubes 206, 506. One or more seals (e.g., o-ring seals, etc.) may be used to provide a fluid tight connection between the jumper tube 501 and the end of the respective shunt tube 206, 506. Similar jumper tubes 501 may be used to couple any additional shunt tubes 206 and/or packing tubes 302 being fluidly coupled between the adjacent joints of wellbore tubulars 120, 520.

Having fluidly coupled the shunt tubes 206 and any additional tubes on the adjacent joints of wellbore tubulars 120, 520, an additional shroud 503 may be used to protect the jumper tubes 501. In an embodiment, the shroud 503 may be similar to the outer body member 208, and may be configured to be disposed about the jumper tube section 540 to prevent damage to the jumper tubes 501 and ends of the adjacent shunt tubes 206, 506 during conveyance within the wellbore. Once the adjacent wellbore tubulars 120, 520 are coupled and the shroud 503 has been engaged, additional joints of wellbore tubulars may be similarly coupled to the existing joints and/or additional wellbore tubulars may be used to complete the assembled sand screen structure for use in the wellbore.

In addition to the embodiment described above, the shunt rings, stop rings, and/or filter media may be configured to allow both radial rotation of the shunt tube assembly about the wellbore tubular as well as longitudinal translation of the shunt tube assembly. This embodiment may allow for adjacent shunt tubes on adjacent joints of wellbore tubular to be directly coupled without the use of a jumper tube and/or an additional shroud.

Figure 6:
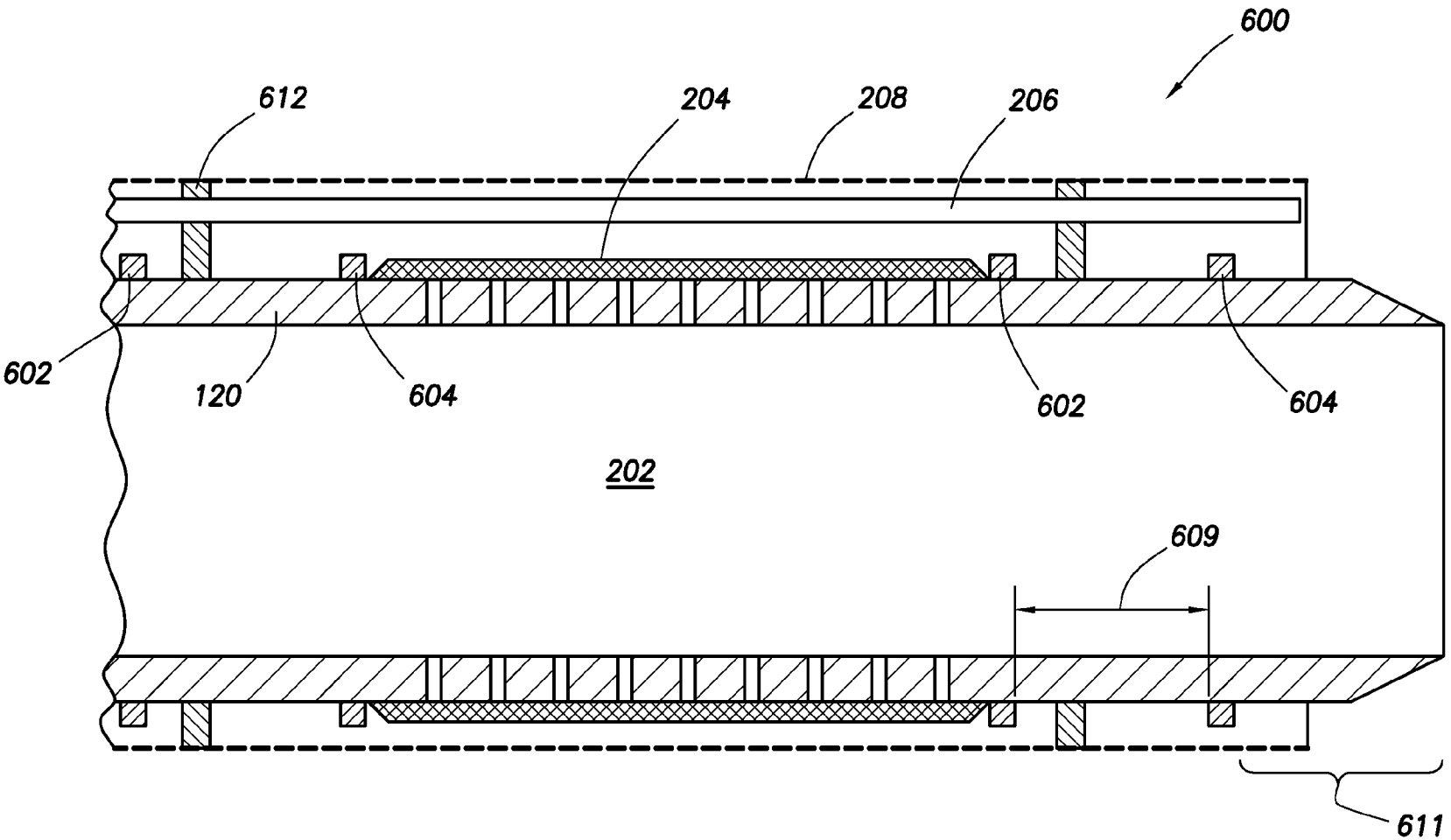
FIG. 6 is a cross-sectional view of another embodiment of a shunt tube assembly.

A cross-sectional view of an embodiment of an individual joint of threaded wellbore tubular comprising a longitudinally translatable shunt tube assembly 600 disposed thereabout is shown in FIG. 6. The shunt tube assembly 600 is similar to the shunt tube assembly 200 described with respect to FIG. 2. Accordingly, similar components will not be described in the interest of clarity. The wellbore tubular 120 comprises a series of perforations 202 disposed therethrough. A filter media 204 is disposed about the wellbore tubular 120 and the series of perforations 202 to screen the incoming fluids from the formation. The shunt tube assembly 600 comprises one or more shunt tubes 206 disposed along and generally parallel to the wellbore tubular 120. An outer body member 208 is disposed about the wellbore tubular 120, the one or more shunt tubes 206, and the filter media 204. In an embodiment, a coupling assembly comprises one or more shunt rings 612 and one or more stop rings 602, 604 configured to retain one or more corresponding shunt rings 612 in position. The coupling assembly may be configured to retain the shunt tubes 206 and/or outer body member 208 about the wellbore tubular 120 while being free to rotate radially and translate longitudinally within the limits of the stop rings 602, 604. The coupling assembly may also be configured to be fixed relative to the wellbore tubular 120 when the shunt tubes 206 are configured in a desired position.

In this embodiment, the stop rings 602, 604 and the shunt rings 612 may be similar to those described with respect to FIG. 2. In this embodiment, the stop rings 602, 604 may be spaced apart by a distance 609 to allow the shunt rings 612 to longitudinally translate within the limits of the stop rings 602, 604. For example, the shunt rings 612 may be disposed about the wellbore tubular 120 as described above and translated to the left in FIG. 6 until the shunt rings 612 engage the stop rings 602. When translated, the shunt tubes 206 and the optional outer body member 208 and/or the packing tubes may be translated with the shunt rings 612, which may retain these components about the wellbore tubular 120. The shunt rings 612 can be translated through the distance 609 to the right in FIG. 6 until the shunt rings 612 engage the stop rings 604. The shunt rings 612 may allow the shunt tube assembly to radially rotate at any point between the stop rings 602, 604. The distance 609 may be selected to provide a desired longitudinal translation distance for providing an exposed section 611 of the wellbore tubular 120 for handling while allowing the end of the shunt tube 206 to be translated into engagement with a shunt tube on an adjacent joint of wellbore tubular.

Figure 7A:
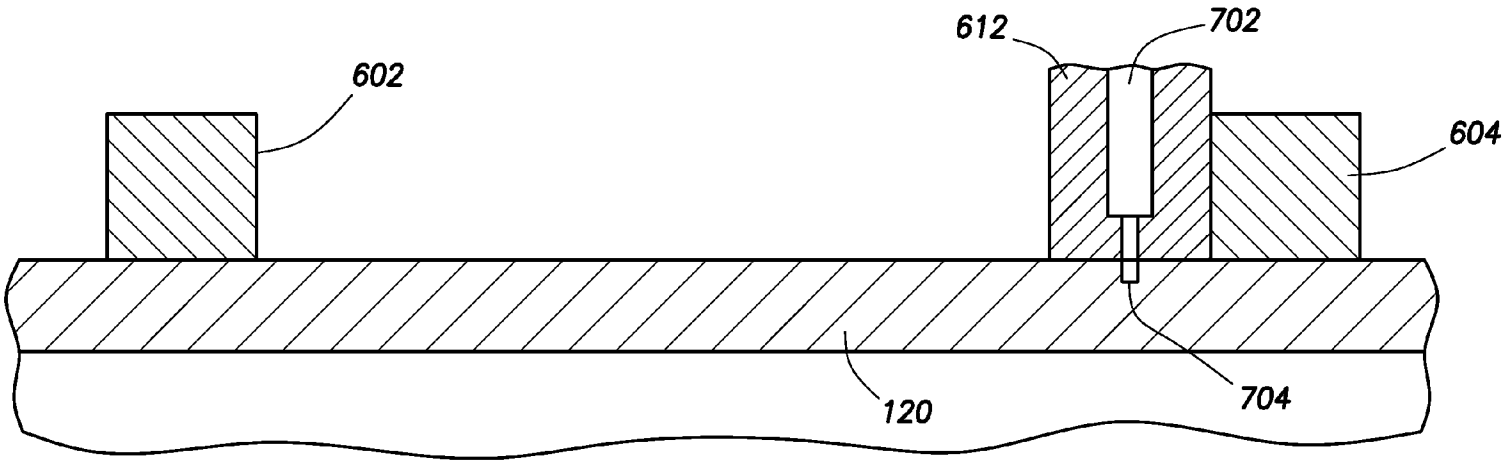
FIGS. 7A-7D are partial cross-sectional views of embodiments of shunt ring assemblies.

A variety of configurations of the coupling assembly comprising the shunt rings 612 and/or stop rings 602, 604 can be used to provide for the rotation and translation of the shunt tube assembly 600 with respect to the wellbore tubular 120. The embodiments illustrated in FIGS. 7A through 7D are similar to those illustrated in FIG. 4A through FIG. 4D, and similar components will not be discussed with respect to FIGS. 7A through 7D for clarity. As shown in FIG. 7A, the shunt ring 612 may be disposed between two stop rings 602, 604 when the shunt ring 612 is disposed about the wellbore tubular 120. In this configuration, the shunt ring 612 may directly engage the wellbore tubular 120, while being free to radially rotate about the longitudinal axis of the wellbore tubular 120 and longitudinally translate between the stop rings 602, 604. A channel 702 may be disposed in the shunt ring 612 and configured to receive a set screw. An optional recess 704 may be disposed within the wellbore tubular 120 near the stop ring 604, which may correspond to a longitudinal alignment with the channel 702 when the shunt ring 612 is engaged with the stop ring 604. In an embodiment, a plurality of channels 702 and optional recesses 704 may be disposed about the circumference of the shunt ring 612 and the wellbore tubular 120, respectively, to allow for a plurality of set screws to be used to retain the shunt ring 612 in a desired position with respect to the wellbore tubular 120. This alignment may correspond to the alignment in which the shunt tube 206 is engaged with a shunt tube on an adjacent section of wellbore tubular 120. In this embodiment, the shunt ring 612 may be engaged with the wellbore tubular 120 between the stop rings 602, 604. The shunt ring 612 and the associated components of the shunt tube assembly may then be rotated into a desired radial alignment with an adjacent wellbore tubular. The shunt ring 612 and associated components can then be longitudinally translated into engagement with a shunt tube on an adjacent wellbore tubular, which may correspond to an alignment in which the shunt ring 612 is engaged with the stop ring 604. One or more set screws can then be engaged with the channels 702 and optional recesses 704 to retain the shunt ring 612 in position.

Figure 7B:
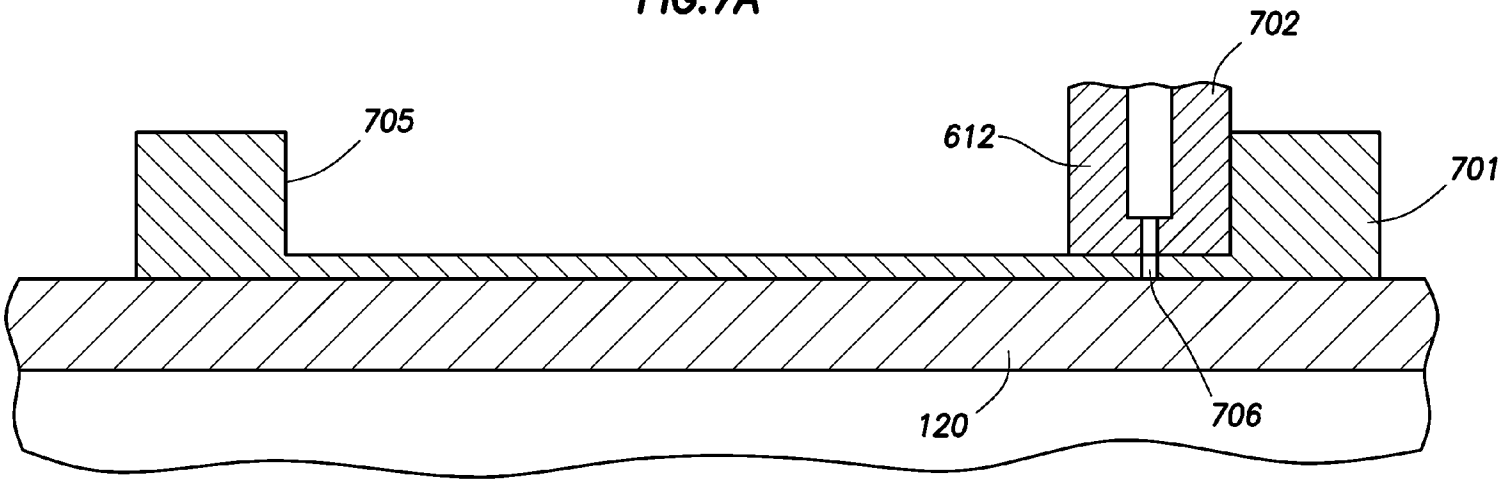

As shown in FIG. 7B, a stop ring 701 comprises a channel 705 for receiving the shunt ring 612. In this configuration, the shunt ring 612 is free to radially rotate about the longitudinal axis of the wellbore tubular 120 and longitudinally translate between the stop rings 210. A channel 702 may be disposed in the shunt ring 612 and configured to receive a set screw. An optional recess 706 may be disposed in the stop ring 701 in alignment with the channel 702 for receiving a set screw or other retaining device positioned within the channel 702. This alignment may correspond to the alignment in which the shunt tube 206 is engaged with a shunt tube on an adjacent section of wellbore tubular 120. In an embodiment, a plurality of channels 702 and optional recesses 706 may be disposed about the circumference of the shunt ring 612 and the stop ring 701, respectively, to allow for a plurality of set screws to be used to retain the shunt ring 612 in a desired position with respect to the wellbore tubular 120. In this embodiment, the shunt ring 612 may first be engaged within the channel 705. The shunt ring 612 and the associated components of the shunt tube assembly may then be rotated into a desired alignment. The shunt ring 612 and associated components can then be longitudinally translated into engagement with a shunt tube on an adjacent wellbore tubular, which may correspond to an alignment in which the shunt ring 612 is engaged with the stop ring 701. One or more set screws can then be engaged with the channels 702 and optional recesses 706 to retain the shunt ring 612 in position.

Figure 7C:
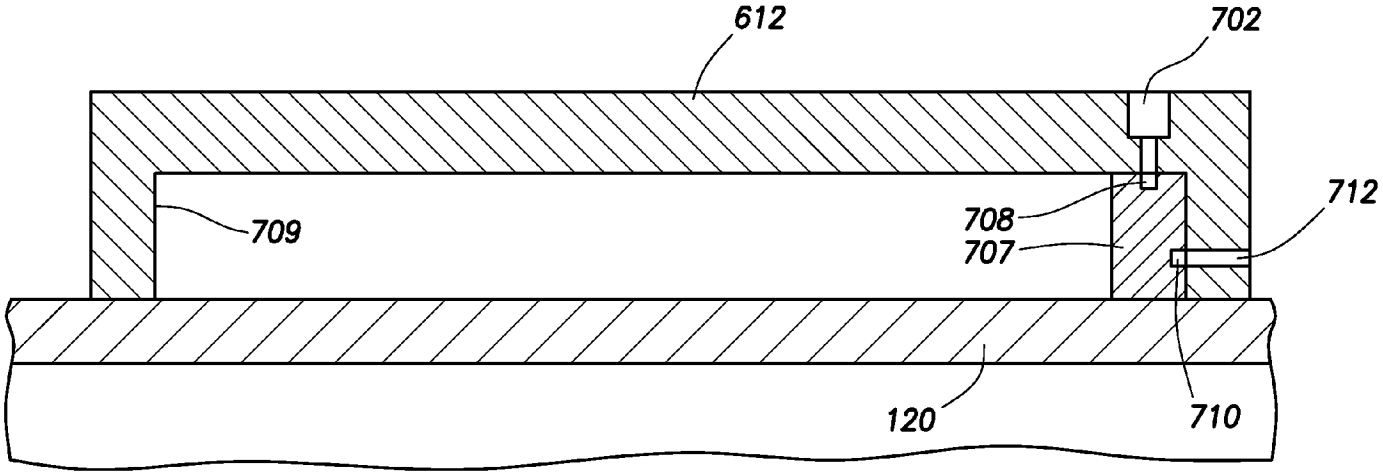

As shown in FIG. 7C, a stop ring 707 comprises a single protrusion that is engaged with the wellbore tubular 120. In this configuration, the shunt ring 612 comprises a channel 709 having a corresponding shape to engage the stop ring 707. The shunt ring 612 may engage the stop ring 707 and/or the wellbore tubular 120, and is free to radially rotate about the longitudinal axis of the wellbore tubular 120 and longitudinally translate between the limits of the stop ring 707 and the inner surfaces of the channel 709. A channel 702 may be disposed in the shunt ring 612 and configured to receive a set screw. An optional recess 708 may be disposed in the stop ring 707 in alignment with the channel 702 for receiving a set screw or other retaining device positioned within the channel 702. As shown in FIG. 7C, a channel 712 for receiving a set screw may also be disposed in a side wall of the shunt ring 612 and may be aligned with an optional recess 710 in the stop ring 707. In an embodiment, a plurality of channels 702, 712 and optional recesses 708, 710 may be disposed about the shunt ring 612 and the stop ring 707, respectively, to allow for a plurality of set screws to be used to retain the shunt ring in a position with respect to the wellbore tubular 120. This alignment may correspond to the alignment in which the shunt tube 206 is engaged with a shunt tube on an adjacent section of wellbore tubular. In this embodiment, the shunt ring 612 may first be engaged about the stop ring 707. The shunt ring 612 and the associated components of the screen assembly may then be rotated into a desired alignment. The shunt ring 612 and associated components can then be longitudinally translated into engagement with a shunt tube on an adjacent wellbore tubular. One or more set screws can then be engaged with the channels 702, 712 and optional recesses 708, 710 to retain the shunt ring 612 in position.

Figure 7D:
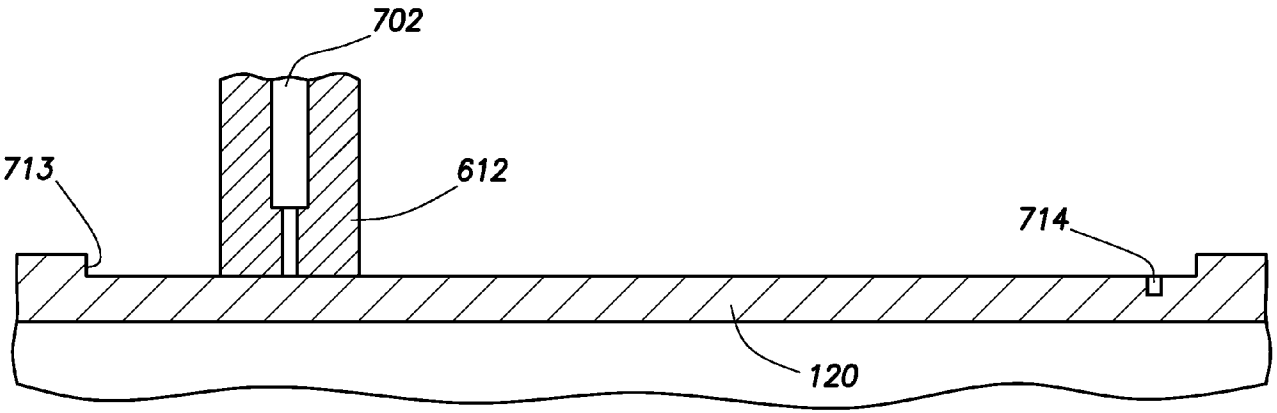

As shown in FIG. 7D, the shunt ring 612 may engage the wellbore tubular 120 without the use of a stop ring. In this embodiment, the wellbore tubular 120 may comprise a channel 713 for receiving the shunt ring 612. The shunt ring 612 may have a corresponding shape to engage the channel 713 in the wellbore tubular 120. Due to the interaction of the shunt ring 612 with the side of the channel 713, the shunt ring 612 may be free to radially rotate about the longitudinal axis of the wellbore tubular 120 longitudinally translated within the limits of the channel 713 with respect to the wellbore tubular 120. A channel 702 may be disposed in the shunt ring 612 and configured to receive a set screw. An optional recess 714 may be disposed in the wellbore tubular 120 in radial alignment with the channel 702 for receiving a set screw or other retaining device positioned within the channel 702. In an embodiment, a plurality of channels 702 and optional recesses 714 may be disposed about the shunt ring 612 and the wellbore tubular 120, respectively, to allow for a plurality of set screws to be used to retain the shunt ring 612 in a rotational position with respect to the wellbore tubular 120. In this embodiment, the shunt ring 612 may first be engaged about the wellbore tubular 120 in engagement with the channel 713 in the wellbore tubular 120. The shunt ring 612 and the associated components of the shunt tube assembly may then be rotated into a desired alignment. The shunt ring 612 and associated components can then be longitudinally translated into engagement with a shunt tube on an adjacent wellbore tubular. One or more set screws can then be engaged with the channels 702 and optional recesses 714 to retain the shunt ring 612 in position.

While illustrated as being fixed in position with one or more set screws, the shunt ring 612 may be retained in position using any of a variety of retaining mechanisms. Suitable retaining mechanisms may include any of those discussed herein with respect to the shunt ring of FIG. 2. With respect to the embodiment of the shunt ring 612 and stop rings 602, 604 of FIG. 6, one or more of the surface features may be radially aligned about the wellbore tubular 120 (i.e., perpendicular to the longitudinal axis of the wellbore tubular). This alignment may aid in preventing the longitudinal translation of the shunt rings 612 after being fixed in position.

Figure 8:
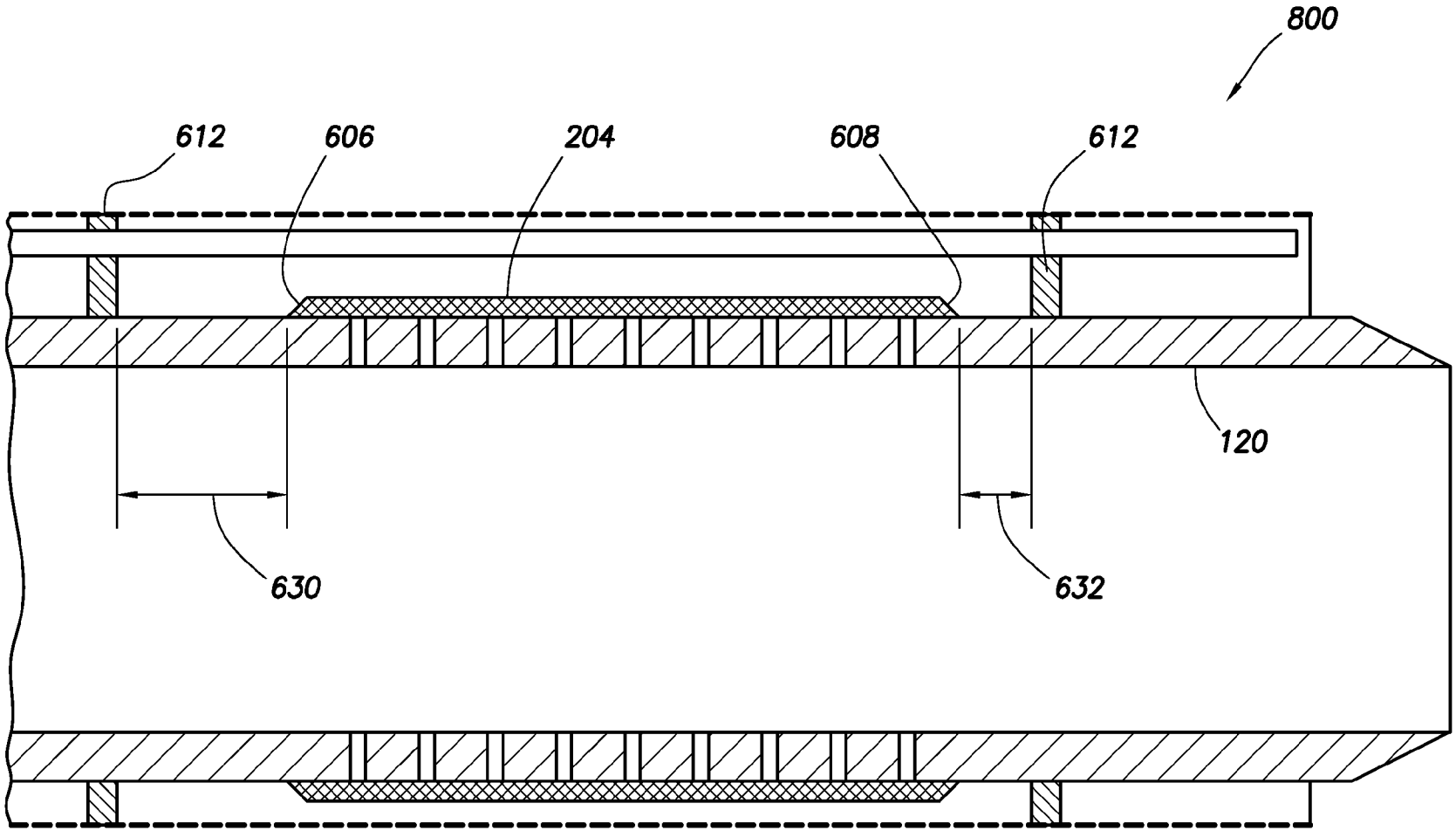
FIG. 8 is a cross-sectional view of still another embodiment of a shunt tube assembly.

FIG. 8 illustrates an embodiment of a shunt assembly 800 in which one or more of the individual stop rings 602, 604 can be omitted and the filter media 204 may serve as a stop ring to limit the longitudinal translation of the shunt rings 612. In this embodiment, the shunt rings 612 may be free to rotate about the wellbore tubular 120, and the shunt rings 612 may longitudinally translate until a shunt ring 612 contacts a surface 606, 608 of the filter media 204. In general, the filter media 204 may be fixedly engaged with the wellbore tubular 120, thereby providing a generally rigid surface for preventing longitudinal translation of the shunt rings 612. The shunt rings 612 may then be configured to translate through a total longitudinal distance comprising the sum of distance 630 and distance 632. Thus, the length of the filter media and/or the distance between the shunt rings may be configured to provide the desired longitudinal translation distance for the shunt tube assembly.

Figure 9A:
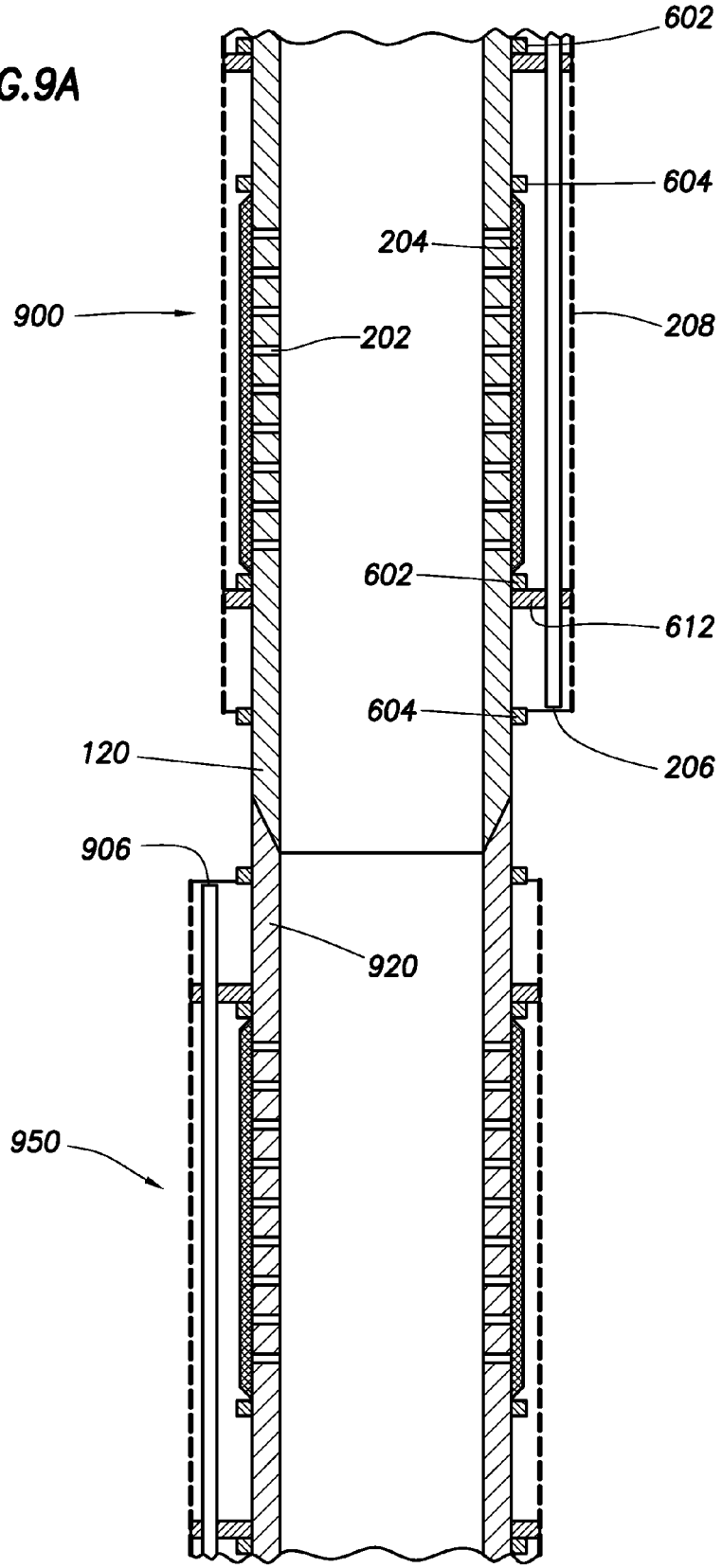
FIGS. 9A-9C are partial cross-sectional views of an embodiment of a shunt tube assembly during an embodiment of a coupling process.

The radially rotating and longitudinally translating shunt tube assembly may be prepared in a similar manner as described above with respect to FIGS. 5A and 5B. In an embodiment as shown in FIG. 9A, the overall assembly process may begin by providing a wellbore tubular 120 having the series of perforations 202, the filter media 204, and the stop rings 602, 604 coupled thereto. A shunt tube assembly 900 comprising the shunt rings 612 coupled to the shunt tubes 206, and optionally one or more packing tubes and/or the outer body member 208 may then be engaged with the wellbore tubular 120, with the shunt rings 612 being engaged with the stop rings 602, 604 and/or the wellbore tubular 120 as described herein. The completed shunt tube assembly 900 on the joint of wellbore tubular 120 may then be ready for coupling to an adjacent joint of wellbore tubular 920.

Figure 9B:
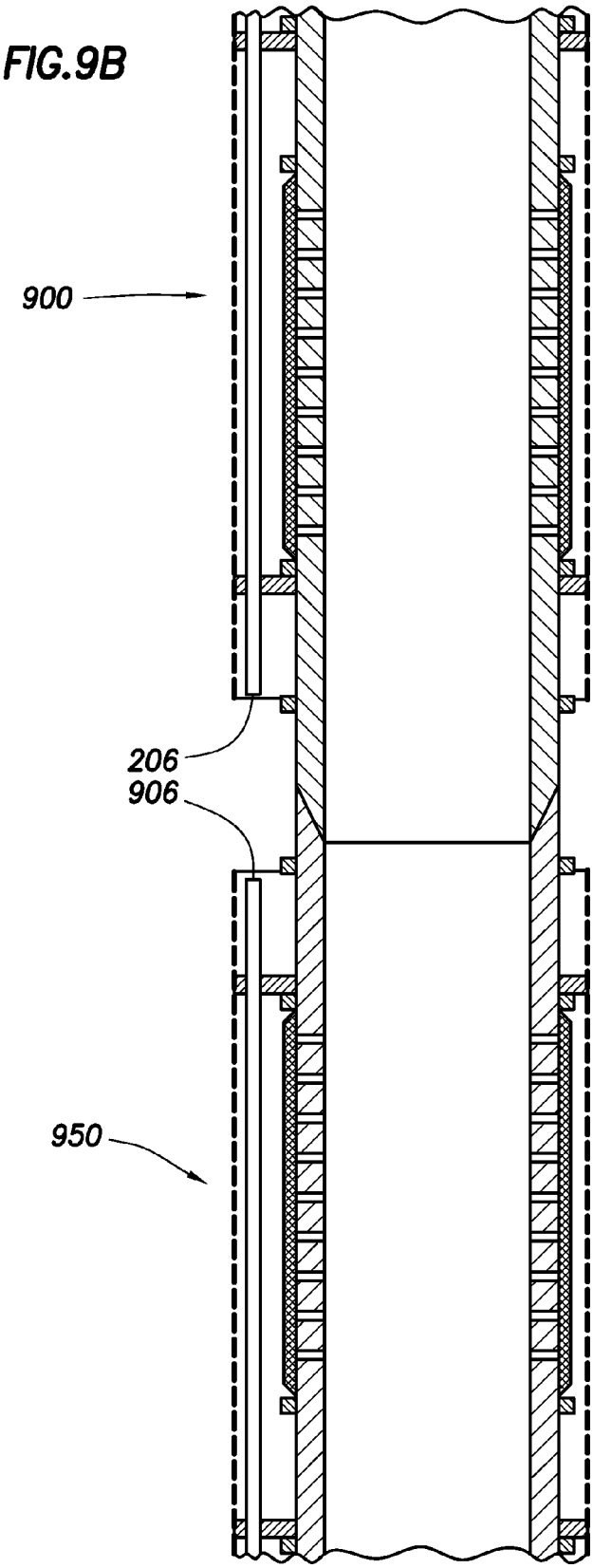

As shown in FIG. 9A, the coupling process of the joints may start with the coupling of a first joint of wellbore tubular 120 comprising a first shunt tube assembly 900 to a second joint of wellbore tubular 920 comprising a second shunt tube assembly 950. The wellbore tubular sections 120, 920 may generally comprise a pin and box type connection that can be threaded together and torqued according to standard connection techniques. Once coupled, the end of a first shunt tube 206 of the first shunt tube assembly 900 may be out of alignment with the adjacent end of a second shunt tube 906 of the second shunt tube assembly 950. As illustrated in FIG. 9B, the entire shunt tube assembly 900 may be rotated about the longitudinal axis of the wellbore tubular 120 to substantially axially align the first shunt tube 206 with the adjacent end of a second shunt tube 906.

Once the adjacent shunt tubes 206, 906 are substantially aligned, the entire shunt tube assembly 900 may be longitudinally translated to engage the first shunt tube 206 with the adjacent end of the second shunt tube 906. The resulting configuration may be similar to that shown in FIG. 9C. A coupling assembly similar to that used with the jumper tubes may be used to couple the individual shunt tubes 206, 906. One or more seals (e.g., o-ring seals, etc.) may be used to provide a fluid tight connection between the ends of the respective shunt tube 206, 906. The translation of the shunt tube assembly 900 may also result in the coupling of any additional shunt tubes and/or packing tubes between the adjacent joints of screen assemblies. In an embodiment, a separate coupling component may be coupled to the end of the shunt tube 906 and provide an upper receptacle for receiving the adjacent end of the shunt tube 206. The coupling component may provide one or more seals for providing a fluid tight connection between the adjacent shunt tubes 206, 906. The longitudinal translation of the shunt rings 612 and associated components may also result in the outer body member 208 engaging or substantially approaching the outer body member 908 on the second shunt tube assembly 950.

Once the adjacent shunt tubes 206, 906 and any additional tubes have been coupled, the shunt rings 612 may be restrained from further radial rotation and longitudinal translation using any of the retaining mechanisms described above. For example, one or more set screws may be disposed in a channel and/or recess in the shunt rings 612 and/or stop rings 602, 604 to limit any further movement of the shunt ring 612 relative to the wellbore tubular 120. Having fluidly coupled the shunt tubes 206, 906 and any additional tubes on the adjacent joints of wellbore tubulars 120, 920, additional joints may be similarly coupled to the existing joints and/or additional wellbore tubulars may be used to complete the assembled sand screen structure for use in the wellbore. It can be noted that the ability to translate the shunt rings 612 and associated components may eliminate or reduce the need for any jumper tubes and/or additional shrouds.

Figure 9C:
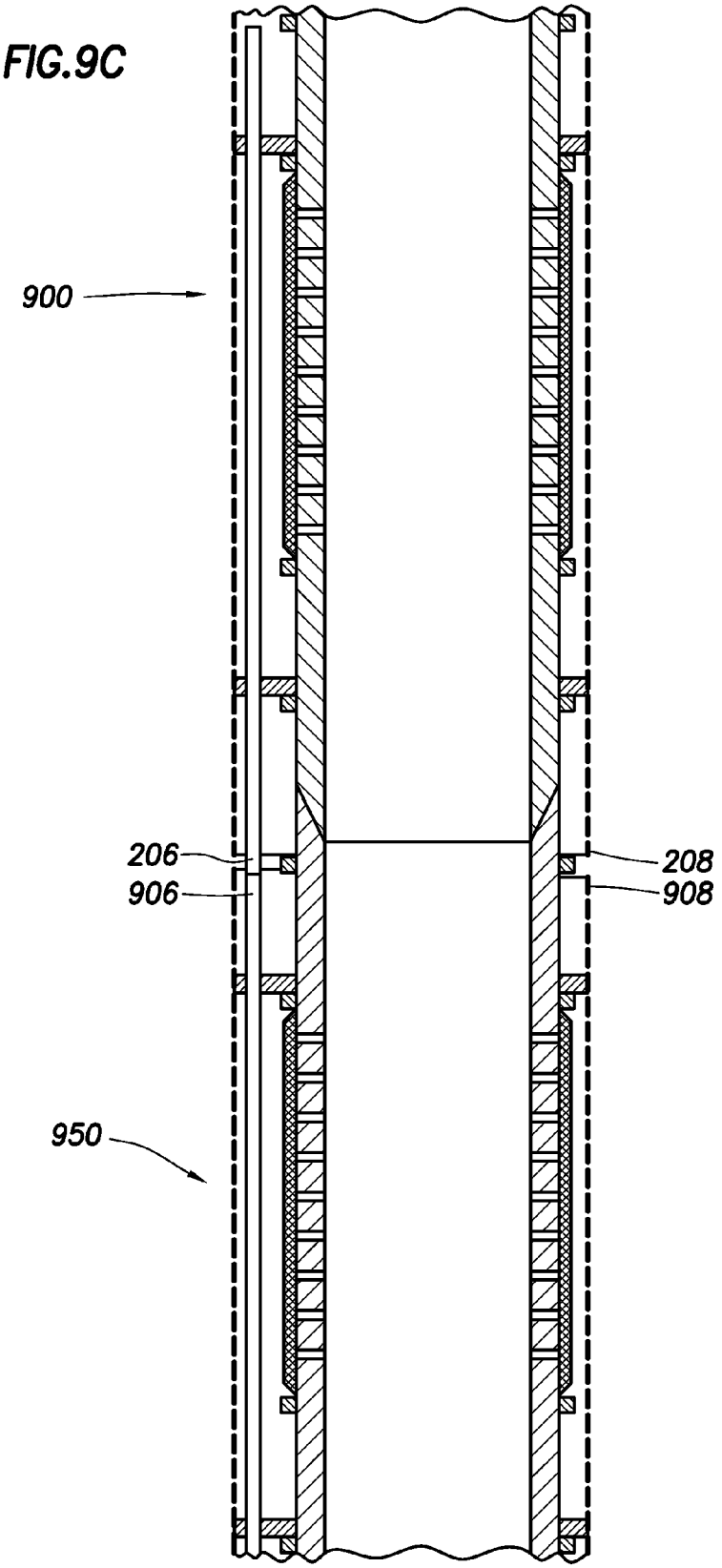

Once assembled, the shunt tube assembly disposed on the wellbore tubular of FIG. 5B or 9C can be disposed within a wellbore for use in forming a sand screen. Referring again to FIG. 1, after the assembled sand screen structure is installed in the wellbore 114, a packing sand/gel slurry can be forced downwardly into the annulus between the casing and the sand screen to form the pre-filtering sand pack around the screen structure. In the event that an annular sand bridge is created externally around the sand screen structure, the slurry is caused to bypass the sand bridge by flowing into the shunt tubes downwardly through the shunt tubes, and then outwardly into the casing/sand screen annulus beneath the sand bridge. When flowing through the shunt tubes, the packing sand/gel slurry may pass through one or more connections comprising jumper tubes prepared using a rotating screen assembly and/or a rotating and translating screen assembly. Once the gravel pack has been formed as desired, a fluid may be allowed to flow through the gravel pack, through the slots in the outer body member, through the filter media, and into the throughbore of the wellbore tubular where it may be produced to the surface.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A tubular assembly comprising:

a wellbore tubular;

at least one shunt tube;

a coupling assembly configured to rotatably couple the at least one shunt tube to the wellbore tubular, wherein the coupling assembly is configured to allow the at least one shunt tube to be longitudinally translated over at least a portion of the wellbore tubular, and wherein the coupling assembly comprises a plurality of shunt rings rotatably disposed about the wellbore tubular; and a plurality of stop rings, wherein a first shunt ring of the plurality of shunt rings is disposed between two adjacent stop rings of the plurality of stop rings, and wherein the plurality of stop rings are configured to limit the longitudinal translation of the first shunt ring and the at least one shunt tube along the wellbore tubular.

2. The tubular assembly of claim 1, further comprising a filter media disposed about the wellbore tubular.

3. The tubular assembly of claim 2, wherein the plurality of shunt rings are configured to retain the at least one shunt tube, and wherein the plurality of stop rings comprise one or more ends of the filter media.

4. The tubular assembly of claim 1, further comprising at least one packing tube in fluid communication with the at least one shunt tube, wherein the coupling assembly is further configured to rotatably couple the at least one packing tube to the wellbore tubular.

5. The tubular assembly of claim 1, further comprising an outer body member disposed about the at least one shunt tube and wellbore tubular.

6. The tubular assembly of claim 1, wherein the plurality of shunt rings are configured to retain the at least one shunt tube, and wherein the plurality of stop rings are configured to limit the longitudinal translation of the plurality of shunt rings along the wellbore tubular.

7. The tubular assembly of claim 6, further comprising a plurality of shunt tubes, and wherein the plurality of shunt tubes are eccentrically aligned about the wellbore tubular.

8. The tubular assembly of claim 6, wherein a first stop ring of the plurality of stop rings comprises a channel for receiving a first of the plurality of shunt rings.

9. The tubular assembly of claim 6, wherein a first stop ring of the plurality of stop rings comprises a protrusion, and wherein a first shunt ring of the plurality of shunt rings comprises a channel that engages the protrusion of the first stop ring.

10. The tubular assembly of claim 1, wherein the wellbore tubular comprises a channel, and wherein a first shunt ring of the plurality of shunt rings is retained within the channel.

11. A method comprising:

coupling a shunt tube to a coupling assembly;

rotatably coupling the coupling assembly to a wellbore tubular, wherein the coupling assembly is configured to allow the shunt tube to be longitudinally translated over at least a portion of the wellbore tubular;

coupling the wellbore tubular to a second wellbore tubular;

rotating a second shunt tube about the second wellbore tubular until the second shunt tube is substantially aligned with the shunt tube; and directly coupling the shunt tube to the second shunt tube without a jumper tube.

12. The method of claim 11, wherein the coupling assembly comprises a plurality of shunt rings, and wherein at least one of the plurality of shunt rings comprises a hinged clamp.

13. The method of claim 11, wherein coupling the shunt tube to the second shunt tube comprises:

longitudinally translating the second shunt tube into engagement with the shunt tube.

14. The method of claim 11, further comprising restraining the second shunt tube from further movement using a retaining mechanism after the rotating step.

15. The method of claim 11, wherein coupling the shunt tube to the second shunt tube comprises longitudinally translating the second shunt tube into engagement with a receptacle, wherein the receptacle is coupled to the shunt tube.

16. The method of claim 11, further comprising a filter media disposed about the wellbore tubular.

17. The method of claim 16, wherein the coupling assembly comprises a plurality of shunt rings configured to retain the shunt tube, wherein the filter media is configured to limit the movement of the one or more shunt rings about the wellbore tubular.

18. The method of claim 16, wherein the coupling assembly comprises a plurality of shunt rings disposed about the wellbore tubular.

19. The method of claim 18, wherein a first shunt ring of the plurality of shunt rings is disposed on a first side of the filter media, and wherein a second shunt ring of the plurality of shunt rings is disposed on a second side of the filter media.

20. The method of claim 11, wherein rotating the second shunt tube about the second wellbore tubular comprises rotating the second shunt tube about a filter media disposed about the second wellbore tubular.

* * * * *